US007647849B2

(12) United States Patent
Miyake

(10) Patent No.: US 7,647,849 B2
(45) Date of Patent: Jan. 19, 2010

(54) STARTER WITH INTERMEDIATE GEAR

(75) Inventor: Shinya Miyake, Anjo (JP)

(73) Assignee: Denso Corporation, Kariya (JP)

( * ) Notice: Subject to any disclaimer, the term of this patent is extended or adjusted under 35 U.S.C. 154(b) by 476 days.

(21) Appl. No.: 11/368,376

(22) Filed: Mar. 7, 2006

(65) Prior Publication Data

US 2006/0219032 A1 Oct. 5, 2006

(30) Foreign Application Priority Data

Mar. 29, 2005 (JP) ..... 2005-093792

(51) Int. Cl.
*F02N 15/02* (2006.01)
*F02N 11/00* (2006.01)

(52) U.S. Cl. ..... 74/7 E; 74/7 R; 74/7 C; 403/379.3

(58) Field of Classification Search ..... 74/6, 74/7 R, 7 C, 7 E; 403/379.2, 379.3
See application file for complete search history.

(56) References Cited

U.S. PATENT DOCUMENTS 4,900,178 A * 2/1990 Haldric et al. ..... 403/24
5,090,833 A * 2/1992 Oertle et al. ..... 403/12
5,165,293 A * 11/1992 Kittaka et al. ..... 74/7 A
5,258,674 A * 11/1993 Sakamoto et al. ..... 310/83
5,265,485 A * 11/1993 Sakamoto et al. ..... 74/7 E
6,647,812 B2 11/2003 Nito et al.
6,880,415 B2 4/2005 Nito
2002/0069713 A1 * 6/2002 Nito et al. ..... 74/7 E
2003/0154808 A1 * 8/2003 Nito ..... 74/6
2005/0016484 A1 1/2005 Oka et al.

FOREIGN PATENT DOCUMENTS

JP A-UM-S60-061407 4/1985
JP A-UM-H02-145604 12/1990
JP A-UM-H05-047305 6/1993
JP Y2 2515607 10/1996
JP A-H11-081924 3/1999
JP A 2002-180937 6/2002
JP A 2003-239834 8/2003
JP A-2005-002884 1/2005

OTHER PUBLICATIONS

Foreign Office Action, dated Feb. 17, 2009.

* cited by examiner

*Primary Examiner*—Richard W L Ridley
*Assistant Examiner*—Thomas Diaz
(74) *Attorney, Agent, or Firm*—Oliff & Berridge, PLC

(57) ABSTRACT

A starter 1 with an intermediate gear is disclosed having a housing 12 formed with first and second bearing portions 17, 18 between which an intermediate shaft 5 is supported. The second bearing portion 18 has a mounting aperture 22 to which a retainer 13 is inserted. The retainer 13 includes a screw having a distal end, formed with a male threaded portion 13*a*, and an engagement portion 13*c* formed between a head portion 13*b* and the male threaded portion 13*a*. The intermediate shaft has one end formed with a cutout surface 5*a*. With the intermediate shaft 5 having both ends supported by the first and second bearing portions 17, 18, the engagement portion 13*c* of the retainer 13 is inserted to the mounting aperture 22 into abutting engagement with the cutout surface 5*a* to retain the intermediate shaft 5 in a fixed place.

1 Claim, 8 Drawing Sheets

STARTER WITH INTERMEDIATE GEAR

CROSS REFERENCE TO RELATED APPLICATIONS

This application is related to Japanese Patent Application No. 2005-093792 filed on Mar. 29, 2005, the content of which is hereby incorporated by reference.

BACKGROUND OF THE INVENTION

1. Field of the invention

The present invention relates to starters and, more particularly, to a starter with an intermediate gear adapted to remain in meshing engagement with a pinion gear at all times and operative to be brought into meshing engagement with a ring gear of an engine to perform startup of the engine.

2. Description of the Related Art

An attempt has been made in the related art to provide a starter with an intermediate gear as disclosed in U.S. Pat. No. 5,265,485.

With the starter of such a related art, a housing has through-bores to which both ends of an intermediate shaft are inserted to be supported. The intermediate shaft carries thereon an axially movable intermediate gear with which a pinion gear is held in meshing engagement at all times. During startup of an engine, the intermediate gear is axially moved together with the pinion gear into meshing engagement with a ring gear of the engine.

The intermediate shaft has a rear end coupled to a retainer through which the intermediate shaft is retained to the housing. The retainer has a polygonal shape in cross section and is inserted to a polygonal aperture, formed in the housing, to be fixedly retained.

However, due to a structure wherein the intermediate shaft is inserted to the through-bore from a rear side (at an area closer to the motor) of the housing during assembly, a difficulty is encountered in assembling the intermediate shaft after a yoke of the motor has been fixedly secured to the housing. Accordingly, a need arises for assembling the intermediate shaft before the yoke is assembled to the housing.

Further, the yoke of the motor is employed as a stopper to prevent the retainer, inserted to the polygonal aperture, from dropping off the housing. That is, when the retainer is inserted to the polygonal aperture after which the motor is fixedly mounted to the housing, a front end of the yoke is brought into abutting engagement with the retainer, enabling the retainer to be prevented from dropping off.

With such a structure set forth above, the intermediate shaft and the retainer necessarily need to be assembled before the yoke is fixedly mounted to the housing with the resultant deterioration in assembling capability. Moreover, under circumstances where the yoke is fixedly secured to the housing, the intermediate shaft is hard to be attached to or detached from the housing. Thus, if a need arises for the intermediate gear to be replaced, the yoke is removed from the housing after which the yoke needs to be assembled to the housing again, resulting in extremely deteriorated assembling capability.

SUMMARY OF THE INVENTION

The present invention has been completed with the above issues in mind and has an object to provide a starter with an intermediate gear that is excellent in assembling capability and maintenance ability.

To achieve the above object, a first aspect of the present invention provides a starter with an intermediate gear comprising a housing having first and second bearing portions, a motor mounted on the housing, a pinion shaft connected to the motor to be driven with a rotational force thereof, a pinion gear rotatably supported on the pinion shaft and axially movable thereon, an intermediate shaft having both ends supported by the first and second bearing portions in parallel to the pinion shaft, an intermediate gear rotatably supported on the intermediate shaft and axially movable in meshing engagement with the pinion gear at all times, and a retainer operative to retain the intermediate shaft to the housing. The intermediate gear is axially movable with the pinion gear into meshing engagement with a ring gear of an engine to transfer the rotational force from the pinion gear to the ring gear via the intermediate gear to start up the engine.

One of the first and second bearing portions has a mounting aperture, extending perpendicular to an axis of the intermediate shaft for insertion of the retainer, which has a rear end formed with a female threaded portion. The retainer includes an engagement portion, inserted to the mounting aperture for engagement with the intermediate shaft, and a male threaded portion, formed at a distal end of the engagement portion, which is coupled to the female threaded portion to fixedly secure the intermediate shaft to one of the first and second bearing portions.

With such a structure, the retainer is inserted to the mounting aperture formed in one of the first and second bearing portions such that the engagement portion is brought into abutting engagement with the retainer, thereby retaining the intermediate shaft to the housing. The retainer has the distal end formed with the male threaded portion, which is coupled to the female threaded portion of the mounting aperture formed at the rear area thereof. Thus, the intermediate shaft is retained in a fixed place with no need for using the yoke of the motor, as required in the related art practice, for the purpose of preventing the retainer from dropping off the housing. Therefore, using the retainer allows the retaining of the intermediate shaft even after the motor has been assembled to the housing and, also, the drop-off of the intermediate shaft can be avoided, resulting in improvement in assembling capability.

A second aspect of the present invention provides a starter with an intermediate gear wherein the second bearing portion is formed with a through-bore, for permitting the intermediate shaft to be inserted from a distal end of the housing, which supports the other end of the intermediate shaft.

With such a structure, since the intermediate shaft can be inserted to the through-bore from the distal end of the housing for assembly, no hindrance occurs to the yoke of the motor when assembling the intermediate shaft to the housing, making it possible to assemble the intermediate shaft and the intermediate gear even after the motor has been assembled to the housing.

A third aspect of the present invention provides a starter with an intermediate gear wherein the mounting aperture for insertion of the retainer is formed in the second bearing portion.

Under such a status, using the through-bore, formed in the second bearing portion, provides an ease of confirming an orientation (an angular position in a circumferential direction) of the intermediate shaft at a distal end (in an outer area) of the housing. Therefore, the retainer can be inserted to the mounting aperture under a condition where the intermediate shaft is positioned with respect to a circumferential direction. Thus, the retainer enables retaining work to be carried out for smoothly and easily retaining the intermediate shaft.

A fourth aspect of the present invention provides a starter with an intermediate gear wherein the intermediate shaft is formed with a cutout surface at a position displaced from a center of the intermediate shaft in a radial direction thereof and the engagement portion of the retainer is brought into engagement with the cutout surface to retain the intermediate shaft.

Such a structure results in easy work for the intermediate shaft to be retained merely using a simplified structure in which the engagement portion of the retainer is brought into abutting engagement with the cutout surface formed on the retainer.

A fifth aspect of the present invention provides a starter with an intermediate gear wherein the intermediate shaft is formed with a through-bore extending in a radial direction for permitting the engagement portion of the retainer to be inserted for retaining the intermediate shaft.

As described above, such an arrangement enables the retainer to perform the retaining of the intermediate shaft merely by using a simplified structure wherein the engagement portion of the retainer merely passes through the through-bore formed in the intermediate shaft.

A sixth aspect of the present invention provides a starter with an intermediate gear wherein the housing has a mounting surface to be mounted onto the engine and the first and second bearing portions are formed so as to protrude from the mounting surface toward the engine. The mounting aperture for insertion of the retainer is formed to be perpendicular to the mounting surface.

With such a structure, due to the mounting aperture formed on the mounting surface of the housing in a direction perpendicular thereto, the formation of the mounting aperture can be easily achieved.

A seventh aspect of the present invention provides a starter with an intermediate gear wherein the housing has a mounting surface to be mounted onto the engine and the first and second bearing portions are formed so as to protrude from the mounting surface toward the engine. The mounting aperture for insertion of the retainer is formed at an inclined angle with respect to the mounting surface.

With such a structure, the retainer can be prevented from protruding from the first or second bearing portions formed with the mounting aperture, avoiding the retainer from interfering with the loading surface of the engine.

An eighth aspect of the present invention provides a starter with an intermediate gear wherein a seal member mounted on one of the first and second bearing portions for blocking a gap between the mounting aperture and the retainer.

This precludes foreign materials, such as dusts or water droplets, from entering the gap between the mounting aperture and the retainer to the interior of the housing.

A ninth aspect of the present invention provides a starter with an intermediate gear wherein the retainer is operative to provide a clamping force exerted to the intermediate shaft for coupling the male threaded portion to the female threaded portion.

This makes it possible for preventing the occurrence of looseness of the intermediate shaft, thereby enabling the suppression of fretting abrasion of the intermediate shaft due to vibrations.

A tenth aspect of the present invention provides a starter with an intermediate gear wherein the engagement portion of the retainer has a tapered shape by which the clamping force is exerted to the intermediate shaft.

With such a structure, a retaining force created by the retainer is exerted to the intermediate shaft via the tapered portion of the engagement portion and the intermediate shaft is pressed in a radial direction, enabling the prevention of looseness of the intermediate shaft in a reliable fashion.

An eleventh aspect of the present invention provides a starter with an intermediate gear wherein the engagement portion of the retainer has a head portion, formed at a position opposite to the male threaded portion, through which the clamping force is exerted to the intermediate shaft.

With such a configuration, a retaining force created by the retainer is exerted to the intermediate shaft via the head portion of the retainer and the intermediate shaft is pressed in a direction in which the retainer is clamped, enabling the prevention of looseness of the intermediate shaft.

A twelfth aspect of the present invention provides a starter with an intermediate gear wherein the cutout surface includes a shoulder portion playing a role as a stopper with which the retainer is brought into abutting engagement to preclude axial displacement of the intermediate shaft upon assembly thereof.

With such a configuration, the presence of the shoulder portion enables the intermediate shaft to be reliably positioned in a fixed place to preclude axial displacement of the intermediate shaft, providing a capability of fixedly retaining the intermediate shaft in a fixed place. This allows a minimum number of component parts to be employed to provide a compact and simplified structure.

A thirteenth aspect of the present invention provides a starter with an intermediate gear comprising housing means having first and second bearing portions, motor means mounted on the housing means, a pinion shaft connected to the motor means to be driven with a rotational force thereof, a pinion gear rotatably supported on the pinion shaft and axially movable thereon, an intermediate shaft having both ends supported by the first and second bearing portions of the housing means in parallel to the pinion shaft, an intermediate gear rotatably supported on the intermediate shaft and axially movable in meshing engagement with the pinion gear at all times, and retainer means associated with the intermediate shaft to the housing means. The intermediate gear is axially movable with the pinion gear into meshing engagement with a ring gear of an engine to transfer the rotational force from the pinion gear to the ring gear via the intermediate gear to start up the engine. One of the first and second bearing portions has a mounting aperture, extending perpendicular to an axis of the intermediate shaft for insertion of the retainer means, which has a rear end formed with a female threaded portion. The retainer means includes an engagement portion, inserted to the mounting aperture for engagement with the intermediate shaft, and a male threaded portion, formed at a distal end of the engagement portion, which is coupled to the female threaded portion to fixedly secure the intermediate shaft to the one of the first and second bearing portions.

With such a structure mentioned above, the retainer means is inserted to the mounting aperture formed in one of the first and second bearing portions of the housing means to allow the engagement portion to be brought into abutting engagement with the retainer means, thereby retaining the intermediate shaft to the housing means. With the retainer means having the distal end formed with the male threaded portion that is coupled to the female threaded portion of the mounting aperture formed at the rear area thereof, no need arises for using the yoke of the motor means, as required in the related art practice, for the purpose of preventing the retainer means from dropping off. Therefore, using the retainer means allows the intermediate shaft to be retained even after the motor means has been assembled to the housing means and, also, the drop-off of the intermediate shaft can be avoided, resulting in improvement in assembling capability.

BRIEF DESCRIPTION OF THE DRAWINGS

For a better understanding of the present invention and to show how the same may be carried into effect, there will now be described by way of example only, specific embodiments according to the present invention with reference to the accompanying drawings, in which.

DETAILED DESCRIPTION OF PREFERRED EMBODIMENTS

Now, starters of various embodiments according to the present invention are described with reference to the accompanying drawings.

First Embodiment

Figure 1:
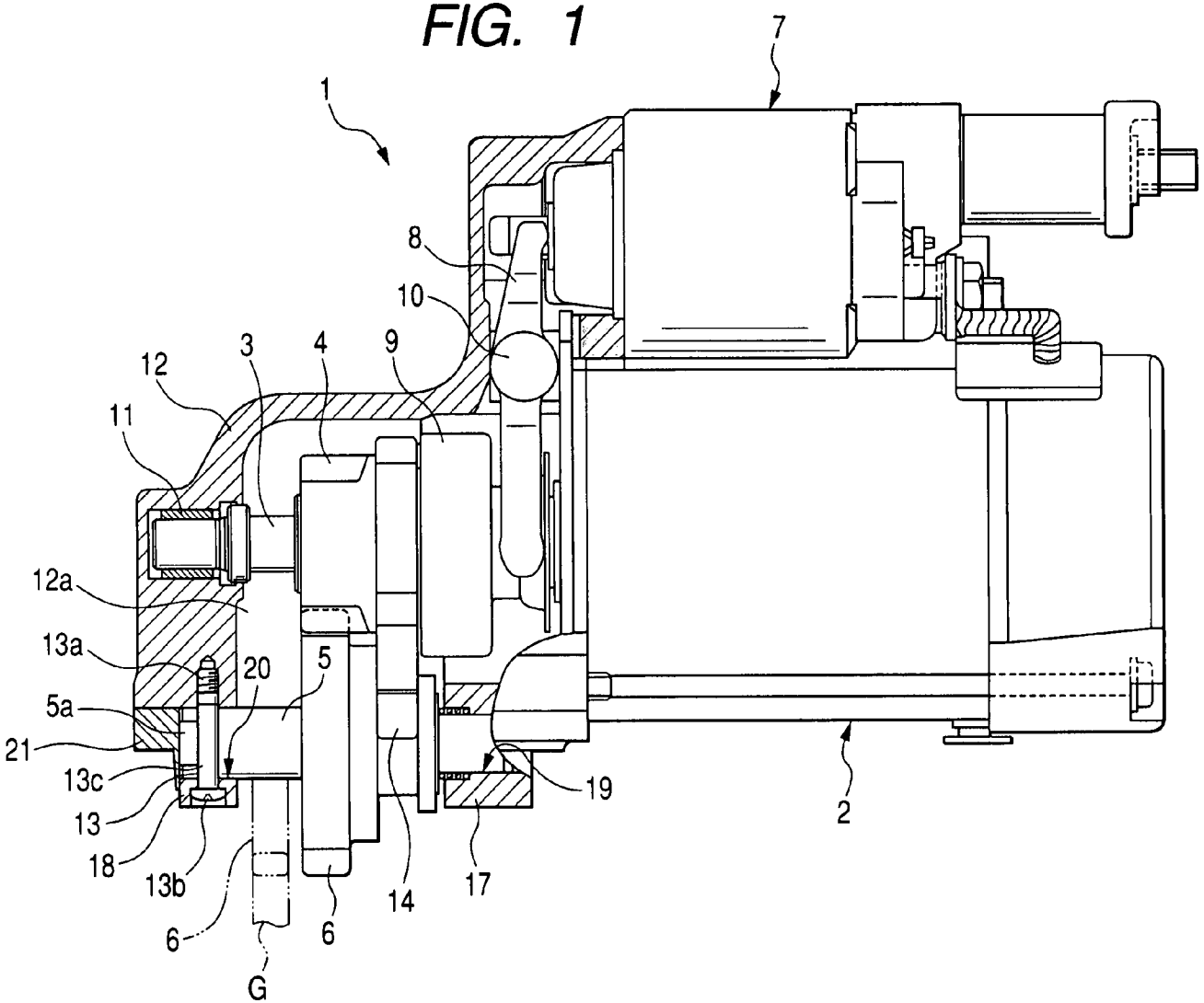
FIG. 1 is a side view of a starter, partly in cross section, of a first embodiment according to the present invention.

FIG. 1 is a side view of a starter with an intermediate gear of a first embodiment according to the present invention partly in cross section.

As shown in FIG. 1, the starter 1 with the intermediate gear of the first embodiment takes the form of a structure, comprised of a motor 2 having a pinion shaft 3 driven by the motor 2, a pinion gear 4 carried by the pinion shaft 3, an intermediate shaft 5 extending parallel to the pinion shaft 3, and an intermediate gear 6 supported on the intermediate shaft 5, wherein the intermediate gear 6 is axially movable with the pinion gear 4 in a direction (leftward in FIG. 1) opposite to the motor 2 to be brought into meshing engagement with a ring gear G of an engine.

The motor 2 may preferably include a well-known direct current electric motor that is connected to a power distribution circuit on which main contacts (not shown) are mounted and operatively closed by an electromagnetic switch 7. The motor 2 has a winding (not shown) that is supplied with electric power from an on-vehicle battery to generate a rotational force upon closing operation of the electromagnetic switch 7.

The electromagnetic switch 7 incorporates therein an excitation coil (not shown), which is conducted to the on-vehicle battery upon closing operation of a starter switch (not shown), and a plunger (not shown), movable inside the excitation coil, which is driven to close the main contacts while causing a shift lever 8 to shift a clutch 9, described below, in an axial direction.

The pinion shaft 3 is coaxially aligned with an axis of an armature of the motor 2 and has a forward end rotatably supported by a housing 12 at a distal end (forward end) thereof by means of a bearing 11. The pinion shaft 3 also has the other end connected to an armature shaft of the motor 2 via a reduction gear unit such as, for instance, a planetary gear reduction unit. Also, the pinion shaft 3 may be directly coupled to the armature shaft without intervening the reduction gear unit.

The pinion gear 4 allows the rotation of the pinion shaft 3 to be transferred through the clutch 9 and is movable on the pinion shaft 3 in association with the clutch 9.

The clutch 9 is coupled to an outer periphery of the pinion shaft 3 through helical spline engagement and takes the form of a one-way clutch that is operative to transfer the rotation of the pinion shaft 3 to the pinion gear 4 while interrupting power transfer between the pinion gear 4 and the pinion shaft 3 so as to preclude the rotation of the engine from being transferred to the pinion shaft 3 when the rotation of the engine is transferred from the ring gear G to the pinion gear 4, that is, when a rotational speed of the pinion gear 4 exceeds a rotational speed of the pinion shaft 3.

The intermediate shaft 5 has both ends carried by the housing 12, with a forward end of the intermediate shaft 5 being fixedly mounted to the housing 12 by means of a retainer 13 that will be described below.

The intermediate gear 6 is rotatably supported on the intermediate shaft 5 in meshing engagement with the pinion gear 4 at all times. Moreover, the intermediate gear 6 is coupled to a connecting portion between the pinion gear 4 and the clutch 6 via an anchor member 14. With such coupling, the intermediate gear 6 is enabled to axially shift on the intermediate shaft 5 in meshing engagement with the pinion gear 4 when the pinion gear 4 moves along the pinion shaft 3 integrally with the clutch 9.

Figure 4:
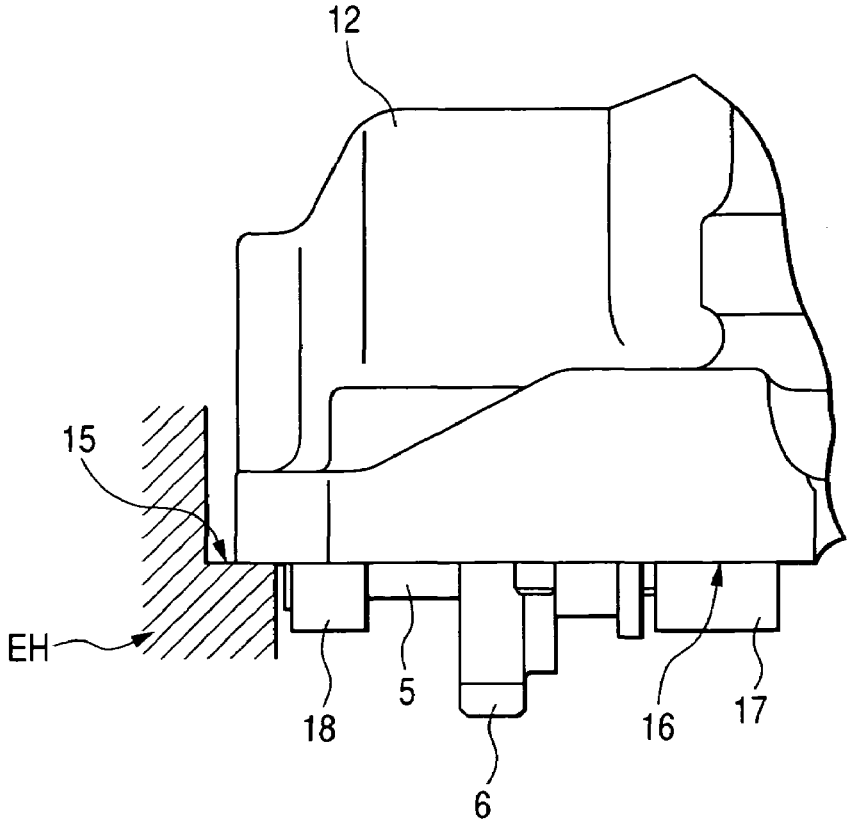
FIG. 4 is a side view of the starter illustrating a loading surface of an engine and a mounting surface of a housing.

As shown in FIG. 4, the housing 12 has a mounting surface 16 that is placed on a starter loading surface 15 of an engine housing EH.

Figure 2:
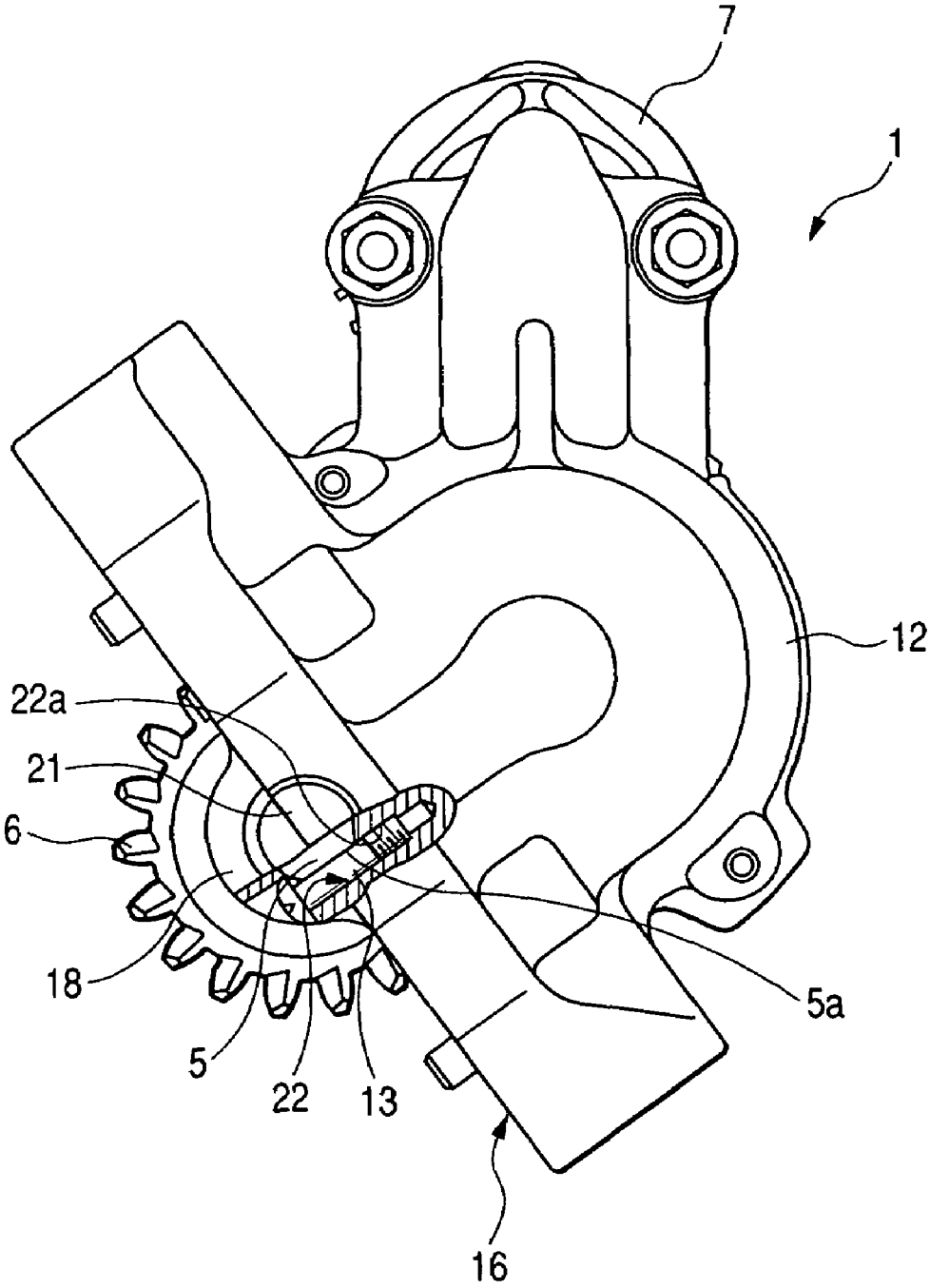
FIG. 2 is a front view of the starter of the first embodiment as viewed in an axial direction thereof.

The mounting surface 16 is formed with an opening portion 12*a*, through which a substantially and radially half part of the intermediate gear 6 is exposed to the outside of the housing 12 from the mounting surface 16 to allow the intermediate gear 6 to be brought into meshing engagement with the ring gear G of the engine as shown in FIGS. 1 and 2.

Further, the housing 12 has first and second axially spaced bearing portions 17, 18, extending downward in parallel to each other as viewed in FIG. 1, by which the intermediate shaft 5 is supported at both axial ends of the opening portion 12*a*.

The first and second bearing portions 17, 18 support the intermediate shaft 5 such that a radial center of the intermediate shaft 5 is substantially aligned on the mounting surface 16. Stated another way, the intermediate shaft 5 has a substantially and radially half upper portion, remaining in the housing 12 at a position upward from the mounting surface 16 (in a direction opposite to the engine), and the substantially half lower portion protruding outward of the housing 12 from the mounting surface 16 (in a direction closer to the engine). In particular, the first and second bearing portions 17, 18 are so configured to protrude outward from the mounting surface 16 on a side closer to the engine as shown in FIG. 4.

The first bearing 17 extends from the housing 12 in the opening portion 12*a* of the housing 12 at a position closer to the motor 2 and has a closed-end aperture 19 that opens in a circular shape in cross section to receive and support a rear end of the intermediate shaft 6. More particularly, the closed-end aperture 19 does not axially extend through the first bearing portion 17 and is bored at a forward end face of the first bearing portion 17 so as to extend toward the motor 2 (from a left side to a right side as viewed in FIG. 1) to an extreme rear end that is closed.

The second bearing portion 18 is formed on the distal end of the housing 12 adjacent to the opening portion 12*a* at a position opposite to the motor 2 and has an axially extending through-bore 20, to which a forward end of the intermediate shaft 5 is fitted and supported.

Also, the intermediate shaft 5 is inserted from the distal end (on a left side as viewed in FIG. 1) of the housing 12 to pass through the through-bore 20 into the interior of the housing 12 until the rear end of the intermediate shaft 5 is inserted to the closed-end aperture 19 and supported by the second bearing portion 17 while the forward end of the intermediate shaft 5 remains stationary in the through-bore 20 and is supported by the second bearing portion 18.

With the intermediate shaft 5 assembled to the second bearing portion 18, a seal member 21 is mounted to the through-bore 20 such that a terminal end of the through-bore 20 is hermetically sealed.

Next, the retaining effect of the intermediate shaft 5 is described below.

The second bearing portion 18 is formed with a mounting aperture 22 (see FIG. 2), for insertion of the retainer 13, which has a rear end formed with a female threaded portion 22*a*. The mounting aperture 22 is formed in the second bearing portion 18 at a position deviated from a center of the through-bore 20 so as to extend in a direction perpendicular to the mounting surface 16 of the housing 12.

The retainer 13 includes a screw having a distal end, formed with a male threaded portion 13*a*, a head portion 13*b*, and an engagement portion 13*c*, formed in a cylindrical column shape or a rectangular column shape, which extends between the head portion 13*b* and the female threaded portion 13*a*.

Figure 3A:
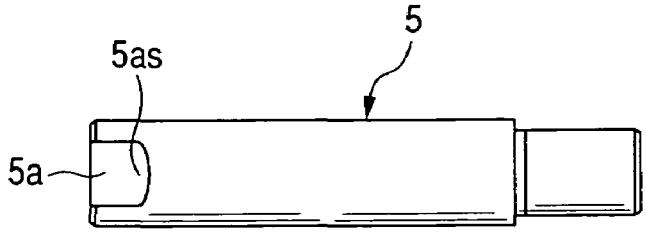
FIG. 3A is a front view of an intermediate shaft showing a cutout surface.
Figure 3B:
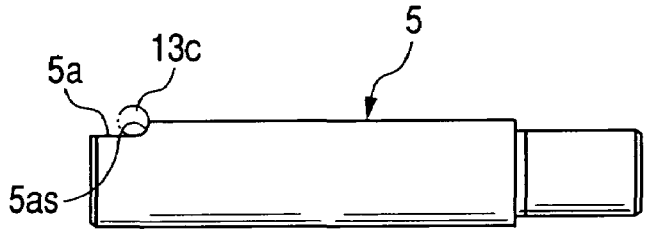
FIG. 3B is a side view of the intermediate shaft shown in FIG. 3A.

As shown in FIGS. 3A ad 3B, the intermediate shaft 5 has a forward end formed with a cutout surface 5*a* on a side opposite to the motor (at a leftward distal position as viewed in FIGS. 3A and 3B). The cutout surface 5*a* is formed on the intermediate shaft 5 at a position radially deviated from a center of the intermediate shaft 5.

More particularly, the cutout surface 5*a* has a shoulder portion 5 as playing a role as a stopper with which the retainer 13 is brought into abutting engagement to preclude axial displacement of the intermediate shaft 5 upon assembly thereof for thereby preventing the intermediate shaft 5 from dropping off the second bearing portion 18 of the housing 12.

Under a status where the first and second bearing portions 17, 18 support both ends of the intermediate shaft 5, the retainer 13 is inserted to the mounting aperture 22 to cause the engagement portion 13*c* to be brought into abutting engagement with the cutout surface 5*a* formed on the intermediate shaft 5, thereby retaining the intermediate shaft 5 in a fixed place. Under such a status, the male threaded portion 13*a* of the screw is screwed into and fixed to the female threaded portion 22*a* of the mounting aperture 22. Also, the engagement portion 13*c* of the retainer 13 remains in abutting engagement with the shoulder 5 as of the cutout surface 5*a* to reliably prevent the intermediate shaft 5 from dropping off the second bearing portion 18.

Now, the operation of the starter 1 with the intermediate gear is described below.

Upon closing operation of a starter switch, the excitation coil of the electromagnetic switch 7 is conducted to cause the electromagnet to attract the plunger, which is consequently moved rightward in FIG. 1. The movement of the plunger is transferred to the clutch 9 via the shift lever 8. When this takes place, both the pinion gear 4 and the clutch 9 move on the pinion shaft 3 in a direction away from the motor 2. Thus, the intermediate gear 6 remains in meshing engagement with the pinion gear 4 and moves on the intermediate shaft 5 into meshing engagement with the ring gear G of the engine.

On the other hand, when the electromagnetic switch 7 closes the main contacts, the motor 2 is supplied with electric power from the on-vehicle battery to cause the armature to generate a rotational force. This rotational force is then delivered through the reduction gear unit to the pinion shaft 3. The rotation of the pinion shaft 3 is transferred through the clutch 9 to the pinion gear 4 and further transferred to the intermediate gear 6 in meshing engagement with the pinion gear 4 at all times. Under such a condition, if the intermediate gear 5 rotates to an angular position available to mesh with the ring gear G of the engine, the intermediate gear 6 is axially forced with a reaction force exerted by, for instance, a drive spring (not shown) incorporated in the electromagnetic switch 7 into meshing engagement with the ring gear G of the engine. This allows the motor 2 to deliver torque to the pinion gear 4 from which torque is further transferred via the intermediate gear 6 to the ring gear G, thereby cranking the engine.

Upon opening operation of the starter switch after startup of the engine, a magnetic force of the electromagnetic switch 7 is extinguished, causing the plunger to be restored to its original position due to a reaction force of a return spring (not shown) incorporated in the electromagnetic switch 7. The returning force, acting on the plunger, is exerted to the clutch 9 via the shift lever 8 and both the pinion gear 4 and the clutch 9 are caused to move on the pinion shaft 3 toward the motor 2. When this takes place, the intermediate gear 6 is brought out of meshing engagement with the ring gear G of the engine and moved (rightward in FIG. 1) on the intermediate shaft 5 in a direction opposite to the ring gear G In the meanwhile, when the electromagnetic switch 7 is turned off to open the main contacts, the motor 2 is turned off, thereby stopping the rotation of the armature.

Advantageous Effect of First Embodiment

With the starter 1 with the intermediate gear set forth above, the retainer 13 is inserted to the mounting aperture 22 of the second bearing portion 18, causing the engagement portion 13*c* of the retainer 13 to be brought into abutting engagement with the cutout surface 5*a* and the shoulder portion 5 as of the intermediate shaft 5 to retain the intermediate shaft 5 in a fixed place. With the male threaded portion 13*a* of the retainer 13 screwed into the female threaded portion 22*a*, formed at the mounting aperture 22 at the rear area thereof, to fixedly secure the retainer 13 to the housing 12, no need arises for the yoke of the motor to be used for preventing the retainer 13 from dropping off the housing 12 as required in the related art mentioned above. With such a configuration, the presence of the retainer 13 enables the intermediate shaft 5 to be retained even after the motor 2 has been assembled to the housing 12. This also enables the retainer 13 from dropping off the housing 12 with the resultant improvement in assembling capability in contrast to a difficulty encountered by the related art set forth above.

Further, with the starter 1 with the intermediate gear of the first embodiment, the intermediate gear 5 can be assembled to the housing 12 on a side near the forward end of the housing 12. That is, the intermediate shaft 5 is inserted through the through-bore 20 of the second bearing 12 from the forward end of the housing 12 and assembled to an interior of the housing 12. Under such a status, the yoke of the motor 2 causes no hindrance to the intermediate shaft 5 during assembly thereof, making it possible to assemble the intermediate shaft to the housing 12 regardless of the presence of or absence of the motor 2 being assembled.

With such a structure set forth above, the intermediate shaft 5 can be attached to or detached from the housing 12 with the motor 2 remaining assembled to the housing 12. Accordingly, there is no need for removing the motor 2 from the housing 12 even when a need arises for the intermediate gear 6 to be replaced and merely removing the retainer 13 enables the intermediate shaft 5 to be taken off from the housing 12 for replacement of the intermediate gear 6. This results in a capability of providing the starter 1 with outstanding maintenance capability.

Furthermore, with the formation of the mounting aperture 22 in the second bearing portion 18 for insertion of the retainer 13, an orientation (location) of the cutout surface 5*a*, formed on the intermediate shaft 5, can be easily confirmed at the forward end (at an outward area) of the housing 12 via the through-bore 20 formed in the second bearing portion 18. This results in a capability of inserting the retainer 13 to the mounting aperture 22 while confirming the location of the cutout surface 5*a* or under a positioned status, enabling work to be done for retaining the intermediate shaft 5 in a smooth and easy fashion through the use of the retainer 13.

Second Embodiment

Figure 5:
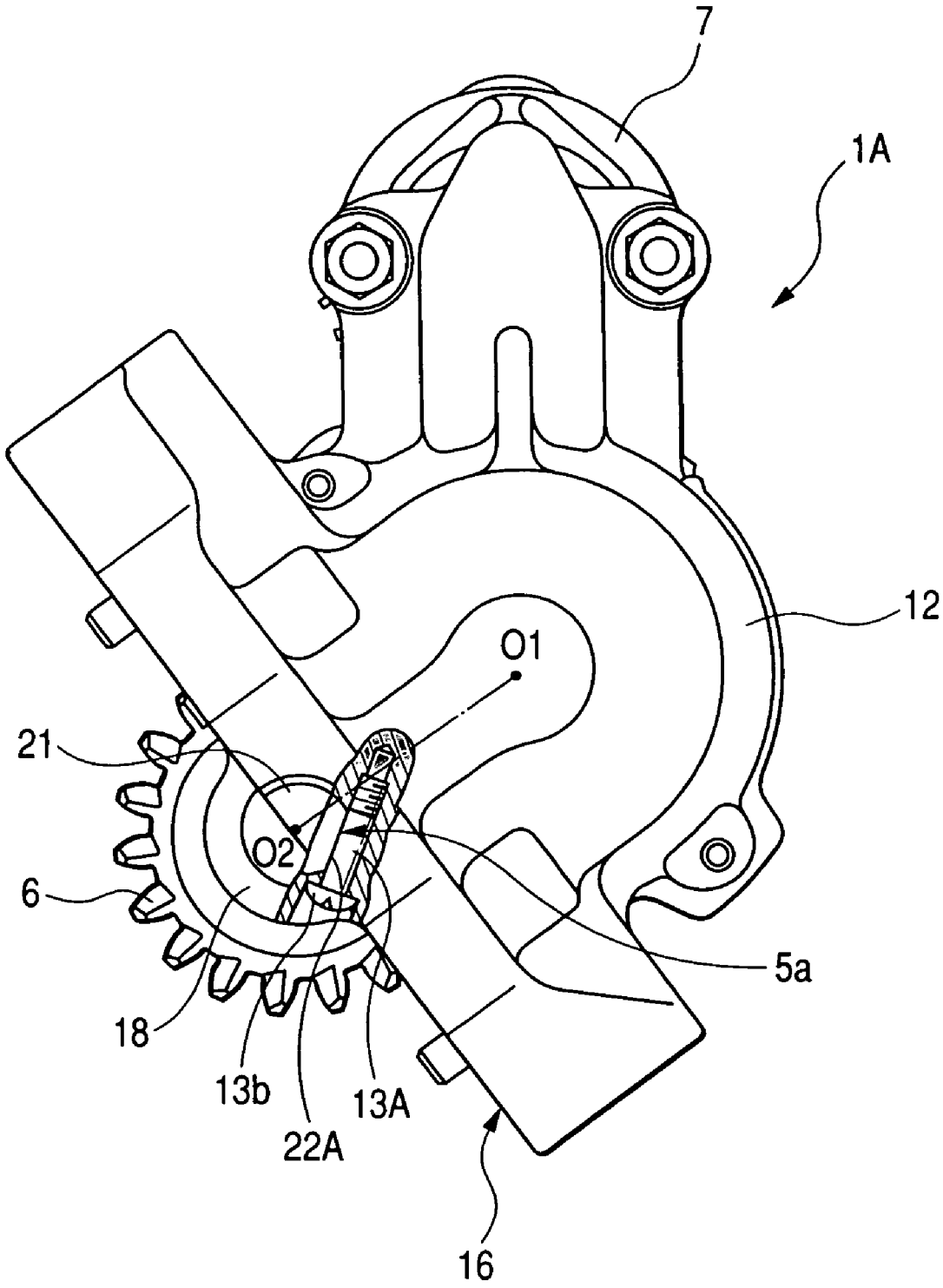
FIG. 5 is a front view of a starter of a second embodiment as viewed in an axial direction thereof.

FIG. 5 is a front view of a starter 1A of a second embodiment according to the present invention.

The second embodiment represents an example of a structure wherein a mounting aperture 22A is formed at an inclined angle with respect to the mounting surface 16 of the housing 12 for insertion of the retainer 13.

The second bearing portion 18, formed with the mounting aperture 22A, has a substantially semicircular shape that protrudes from the mounting surface 16 of the housing 12 toward the engine. As shown in FIG. 5, forming the mounting aperture 22A in a direction intersecting a phantom line O1-O2 extending between a center O1 of the pinion shaft 3 and a center O2 of the intermediate shaft 5 provides an ease of making adjustment such that the head portion 13*b* of the retainer 13 does not protrude from an outer periphery of the second bearing portion 18 with no occurrence of interference with the loading surface 15 of the engine.

Third Embodiment

Figure 6:
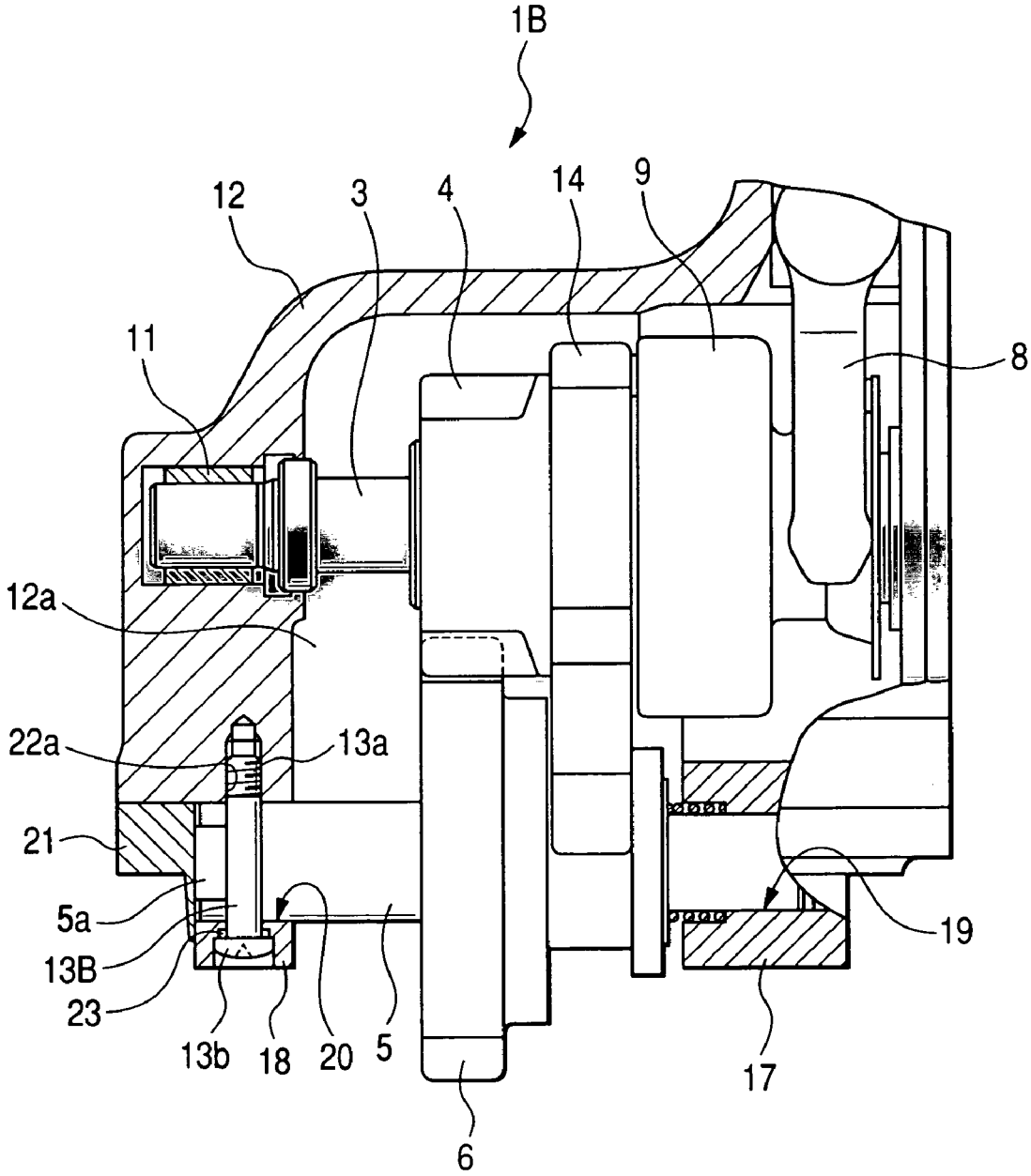
FIG. 6 is a cross sectional view of a starter of a third embodiment showing how a retainer is mounted to a housing.

FIG. 6 is a cross sectional view of a starter 1B of a third embodiment showing a status under which a retainer 13B is mounted.

The third embodiment represents one example of a structure wherein a seal member 23 is positioned in the through-bore 20 to block a gap between the mounting aperture 22 and the retainer 13.

The seal member 23 includes an O-ring made of, for example, rubber and, as shown in FIG. 6, remains sandwiched between the head portion 13*b* of the retainer 13 and a stepped portion of the mounting aperture 22 to seal the gap, created between both the associated component parts, in a liquid-tight fashion. This enables foreign materials such as dusts and water droplets or the like to be prevented from entering an interior of the housing 12 through the gap created between the mounting aperture 22 and the retainer 13.

Other Embodiments

While the first embodiment is described with reference to an exemplary case wherein the retainer 13 fixedly retains the intermediate shaft 5, an alternative structure 1C may be adopted in a configuration wherein a clamping force of a retainer 13C, that is, a clamping force occurring when the male threaded portion 13*a* is screwed into the female threaded portion 22*a*, is exerted to the intermediate shaft 5.

Figure 7:
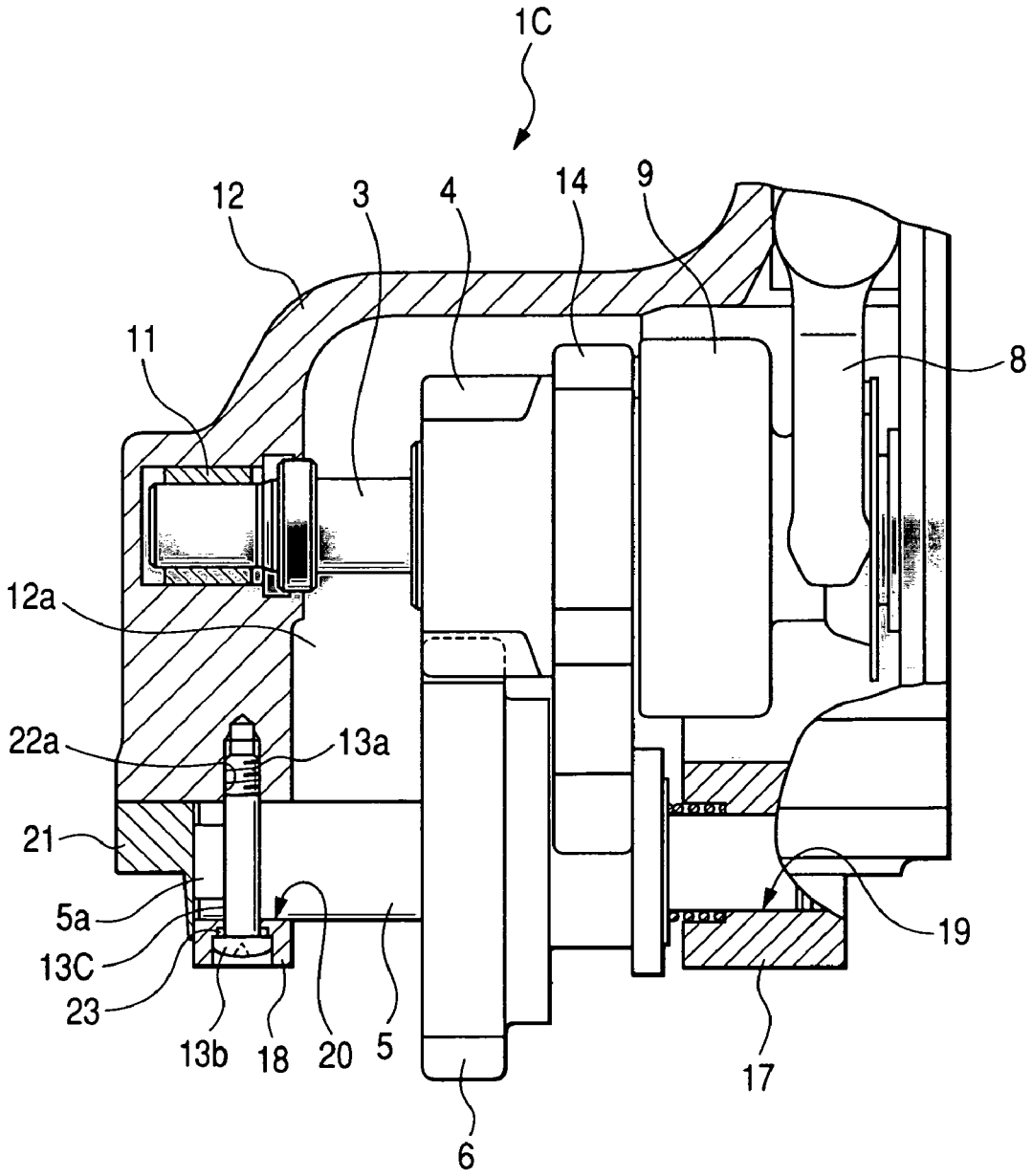
FIG. 7 is a cross sectional view of a starter of a modified form of the first embodiment showing how a retainer is mounted to a housing.

In particular, the alternative structure 1C takes the form of a structure wherein the retainer 13C has an engagement portion formed in a tapered shape, as shown in FIG. 7, so as to exert a clamping force to the intermediate shaft 5 by means of the tapered shape of the engagement portion.

Figure 9:
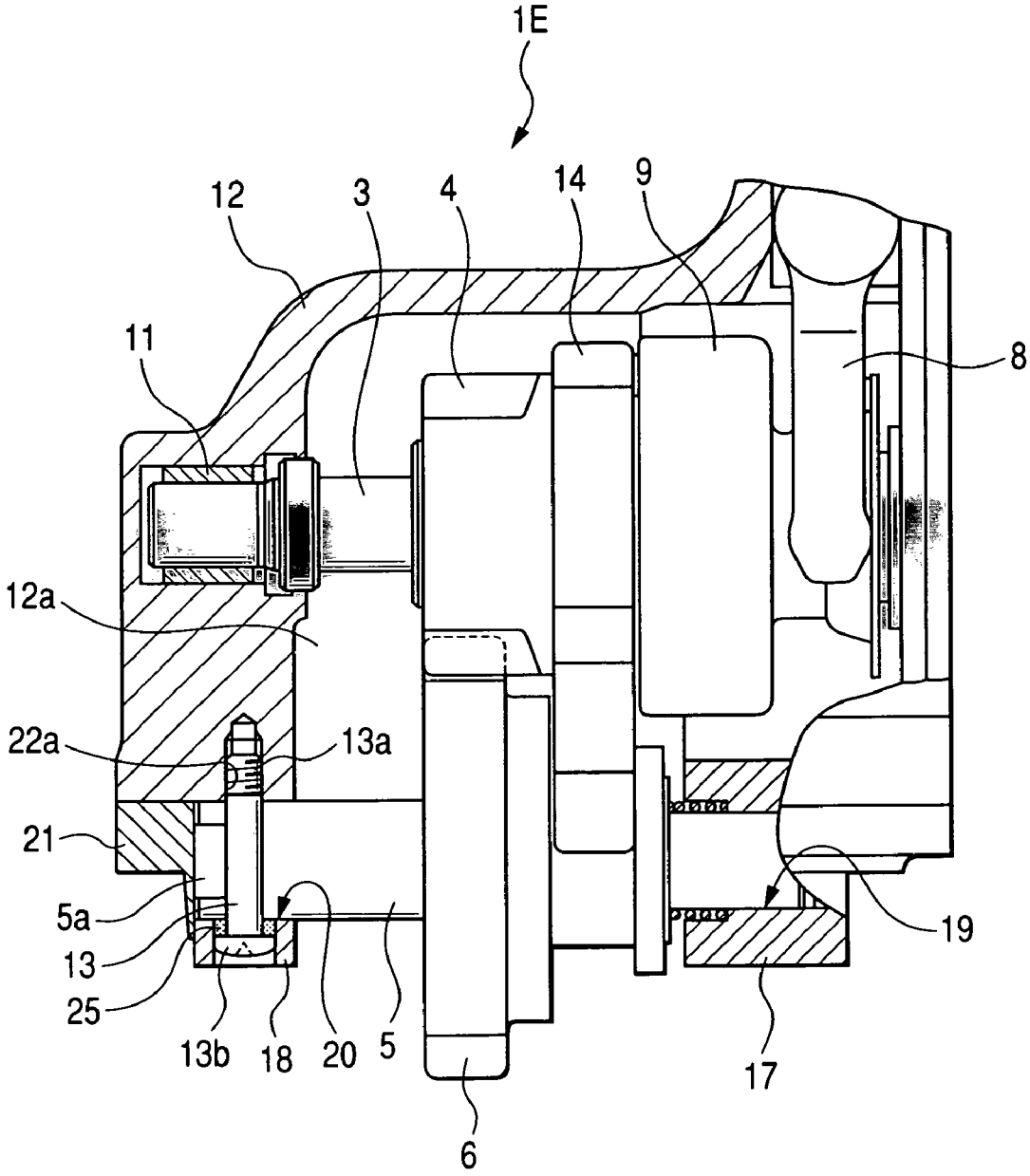
FIG. 9 is a cross sectional view of a starter of a further modified form of the first embodiment showing how a retainer is mounted to a housing.

Another alternative may take the form of a structure 1E wherein the above-described clamping force is exerted to the intermediate shaft 5 by means of a washer 25 and the head portion 13*b* of the retainer 13C as shown in FIG. 9.

With such alternative structures, the intermediate shaft 5 is pressed against an inner peripheral wall of the through-bore 20 to prevent the occurrence of looseness of the intermediate shaft 5. This results in advantageous effects to suppress the occurrence of fretting ablations of the intermediate shaft 5 or the bearing portions 17, 18 due to vibrations.

Figure 8:
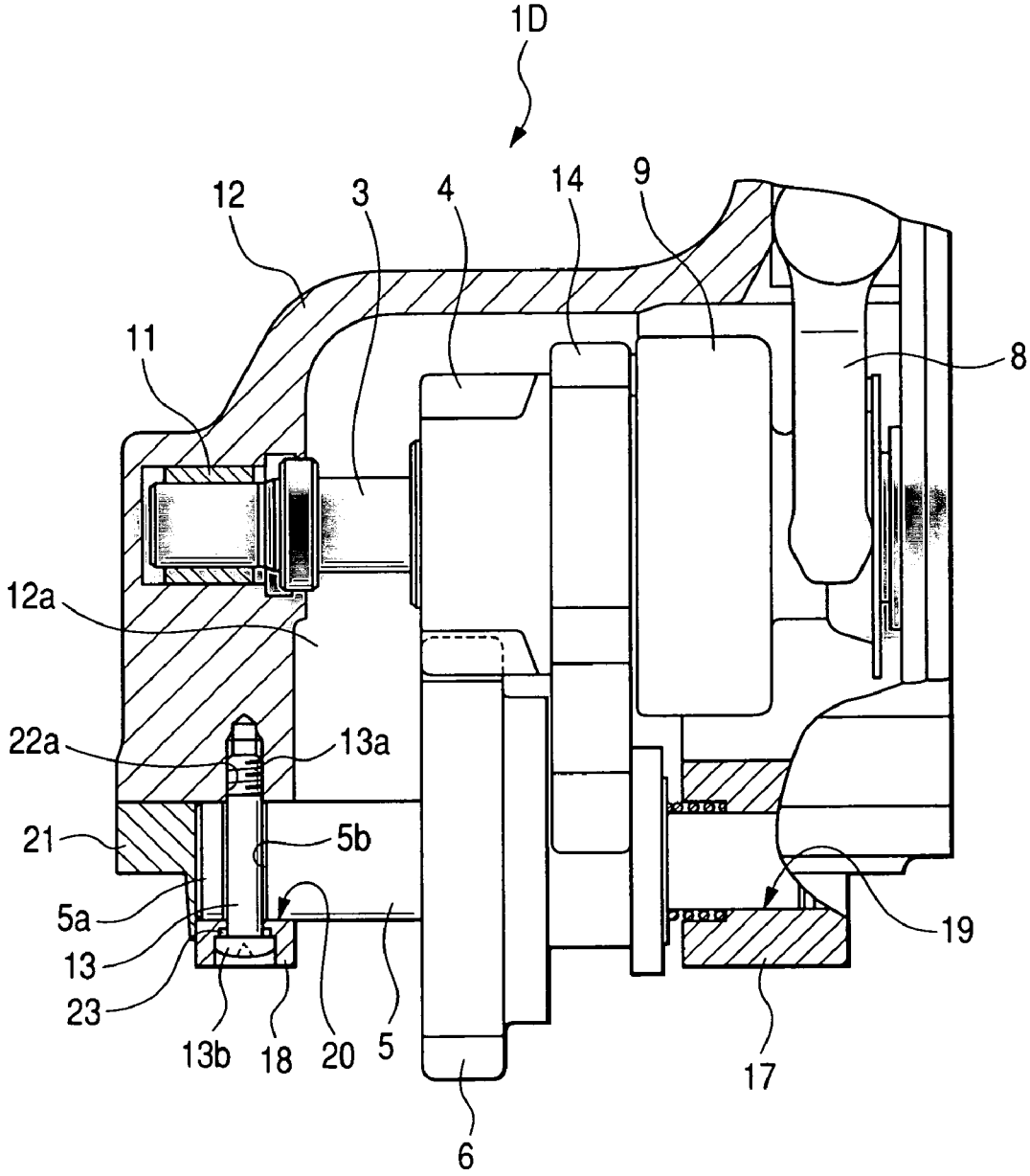
FIG. 8 is a cross sectional view of a starter of another modified form of the first embodiment showing how a retainer is mounted to a housing.

Although the first embodiment has been described in conjunction with an example wherein the cutout surface 5*a* is formed on the intermediate shaft 5 at a terminal end thereof in a position remote from the motor 2, an alternative may take the form of a structure 1D, as shown in FIG. 8, such that the intermediate shaft 5 is formed with a radially extending through-bore 5*b* in place of the cutout surface 5*a*. With such a structure, inserting the retainer 13 to the through-bore 5*b* of the intermediate shaft 5 enables the intermediate shaft 5 to be easily retained in a fixed place.

Further, while the first embodiment has been described with reference to the structure wherein the mounting aperture 22 is formed in the second bearing portion 18 for supporting the terminal end of the intermediate shaft 5 at a position opposite to the motor 2, another alternative may be such that the mounting aperture 22 is formed in the first bearing portion 17 to support the other end of the intermediate shaft 5 at a position closer to the motor 2. With such a structure, the other end of the intermediate shaft 5 may be formed with the cutout 5*a* or the through-bore to which the retainer 13 is fitted to retain the intermediate shaft 5 in the same manner set forth above.

While the specific embodiments of the present invention have been described in detail, it will be appreciated by those skilled in the art that various modifications and alternatives to those details could be developed in light of the overall teachings of the disclosure.

Accordingly, the particular arrangements disclosed are meant to be illustrative only and not limited to the scope of the present invention, which is to be given the full breadth of the following claims and all equivalents thereof.

What is claimed is:

1. A starter with an intermediate gear comprising:

a housing having first and second bearing portions;

a motor mounted on the housing;

a pinion shaft connected to the motor to be driven with a rotational force thereof;

a pinion gear rotatably supported on the pinion shaft and axially movable thereon;

an intermediate shaft, which is in parallel to the pinion shaft, and which has both ends supported by the first and second bearing portions;

an intermediate gear rotatably supported on the intermediate shaft and axially movable in meshing engagement with the pinion gear at all times; and a retainer operative to retain the intermediate shaft to the housing;

wherein the intermediate gear is axially movable with the pinion gear into meshing engagement with a ring gear of an engine to transfer the rotational force from the pinion gear to the ring gear via the intermediate gear to start up the engine;

wherein one of the first and second bearing portions as a mounting aperture, extending perpendicular to an axis of the intermediate shaft for insertion of the retainer, the mounting aperture having a female threaded portion;

wherein the retainer includes an engagement portion, inserted to the mounting aperture for engagement with the intermediate shaft, and a male threaded portion coupled to the female threaded portion to fixedly secure the intermediate shaft to the one of the first and second bearing portions; and wherein a seal member is mounted on one of the first and second bearing portions for blocking a gap between the mounting aperture and the retainer.

* * * * *

UNITED STATES PATENT AND TRADEMARK OFFICE

CERTIFICATE OF CORRECTION

PATENT NO. : 7,647,849 B2
APPLICATION NO. : 11/368376
DATED : January 19, 2010
INVENTOR(S) : Shinya Miyake It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 788 days.

Signed and Sealed this

Twenty-eighth Day of December, 2010

David J. Kappos

David J. Kappos
*Director of the United States Patent and Trademark Office*